US005372424A

United States Patent [19]

Lecouturier

[11] Patent Number: 5,372,424

[45] Date of Patent: Dec. 13, 1994

[54] SCREW MIXER, PARTICULARY FOR FOUNDRY MOLDS

[75] Inventor: Alain-Gabriel Lecouturier, Saint-Gildas-des-Bois, France

[73] Assignee: Assistance Maintenance Industrielle Gildasienne, Saint-Gildas-Des-Bois, France

[21] Appl. No.: 33,559

[22] Filed: Mar. 18, 1993

[30] Foreign Application Priority Data

Mar. 18, 1992 [FR] France ..... 92 03231

[51] Int. Cl.[5] ..... B01F 15/02

[52] U.S. Cl. ..... 366/169; 366/79; 366/172; 137/862; 137/869

[58] Field of Search ..... 137/595, 596.18, 607, 137/862, 869; 251/63.5; 239/412; 366/40, 64, 66, 76, 79, 83, 96–99, 169, 172; 425/208

[56] References Cited

U.S. PATENT DOCUMENTS

| | | | |
|---|---|---|---|
| 2,998,963 | 9/1961 | Rinderle | 366/76 |
| 3,680,597 | 8/1972 | Obermaler | 137/607 |
| 3,773,299 | 11/1973 | Rebish | 366/169 |
| 3,843,100 | 10/1974 | Haas | 366/76 |
| 3,986,709 | 10/1976 | Vermuelen | 366/169 |
| 4,010,001 | 3/1977 | Dollinger | 366/169 |
| 4,118,163 | 10/1978 | Lee | 366/169 |
| 4,126,398 | 11/1978 | Phillips et al. . | |
| 4,139,308 | 2/1979 | Greten | 366/169 |
| 4,143,975 | 3/1979 | Lodige | 366/169 |
| 4,527,902 | 7/1985 | Christen | 366/169 |
| 4,874,014 | 10/1989 | Grant | 251/63.5 |
| 5,180,225 | 2/1993 | Piccolo | 366/84 |

FOREIGN PATENT DOCUMENTS

| | | |
|---|---|---|
| 2281786 | 3/1976 | France . |
| 3708340 | 8/1988 | Germany . |
| 57-136925 | 8/1982 | Japan . |

*Primary Examiner*—David A. Scherbel
*Assistant Examiner*—Terrance R. Till
*Attorney, Agent, or Firm*—Young & Thompson

[57] ABSTRACT

A mixer of the type comprising an axle (2) such as a screw rotatably mounted within a trough (1) is characterized in that the rotatable axle (2) has at its periphery at least one opening comprising an injection point (21) or distribution point of at least one of the constituents of the mixture. The mixer is useful in the production of foundry molds.

7 Claims, 7 Drawing Sheets

SCREW MIXER, PARTICULARY FOR FOUNDRY MOLDS

FIELD OF THE INVENTION

The present invention relates to a mixer of the type comprising a screw mounted rotatably within a trough, said screw comprising on its periphery at least one opening constituting a point of injection or distribution of at least one of the constituents of a mixture adapted for example for the production of materials for foundry molds or cores.

BACKGROUND OF THE INVENTION

Foundry molds are nowadays produced from a mixture of sand, resin and if desired a catalyst. The mixing is a step rendered difficult because of the difference of density and of compactness existing between the sand and the resin. Because of this, it is necessary to use high speeds of rotation and long mixing times. One of the problems encountered in the course of mixing is due to the positioning of the point of injection of the resin which is disposed at the periphery of the trough, which renders more difficult the mixing of the resin with the sand during rotation of the screw and involves moreover a rapid clogging of the injection nozzle as shown in FIG. 1.

A partial solution of the problem is provided by the patent FR-A-2.281.786. This apparatus, adapted to mix foundry sand and binders, comprises two mixers which are disposed one above the other on a common vertical rotating shaft and are surrounded by an external envelope. The introduction of the constituents of the mixture is effected by means of a supply device disposed within the shaft and through radial perforations for the outlet of the product from the shaft. Because of its particular construction, this supply apparatus is applicable only to a vertical mixer to avoid on the one hand any obstruction of the radial perforations, and on the other hand a backing up of the material within the shaft between the external walls of the supply device and the internal walls of the shaft. Moreover, this mixer does not permit precise supply of the injected material. Another process for introducing a constituent of a mixture from the interior of a rotating shaft is also described in Japanese patent application JP-A-57136925. This device is adapted to inject a liquid, in particular water, into a mixture. Its very simple conception is not transposable to the injection of pasty or hardenable products.

SUMMARY OF THE INVENTION

The object of the present invention is therefore to provide a horizontal or vertical mixer permitting a precisely regulated introduction of one of several constituents into the mixture and the use of no matter what constituents thanks in particular to a cleaning of the point on points or injection at all times.

Another object of the present invention is to provide a mixer permitting obtaining a final product whose resistance to bending is increased while diminishing the quantity of resin used as well as the speed of rotation of the screw of the mixer.

The invention relates for this purpose to a mixer of the type comprising an axle, such as a screw, mounted rotatably within a trough and having at its periphery at least one opening constituting a point of injection or of distribution of at least one of the constituents of the mixture, said constituent being supplied to said point of injection by means of a distributor disposed within the axle, characterized in that the distributor comprises at least one injection nozzle, disposed at the point of injection in the wall of the axle, and delimiting an injection channel connected directly to a supply conduit under pressure of the constituent or constituents and at least one jack, actuated with reciprocating axial movement, to pass between an extended position, in which it closes the inlet of the supply conduit under pressure emptying into the injection channel, and a retracted position, in which it exposes the entry of said conduit thereby permitting the communication of the supply conduit with the injection channel of the injection nozzle and therefore the injection into the trough of the constituents contained in the supply conduit.

In a preferred embodiment of the invention, a cleaning fluid supply conduit opens downstream of the inlet point of the supply conduit closed by the jack.

It is to be noted that the mixture is formed, in the case of use for foundry molds or cores, generally of three constituents, the first constituent of the mixture being sand, the second constituent a resin preferably cold hardening, serving as a binder for the sand, the third constituent of which the injection point is disposed for example on the peripheral wall of the trough being an organic catalyst, the mixture of the three constituents forming after hardening the materials of a foundry mold or core.

BRIEF DESCRIPTION OF THE DRAWINGS

Other characteristics and advantages of the invention will become apparent from a reading of the description which follows and the accompanying drawings, which description and drawings are given only by way of example. In these drawings.

DETAILED DESCRIPTION OF THE INVENTION

Figure 1:
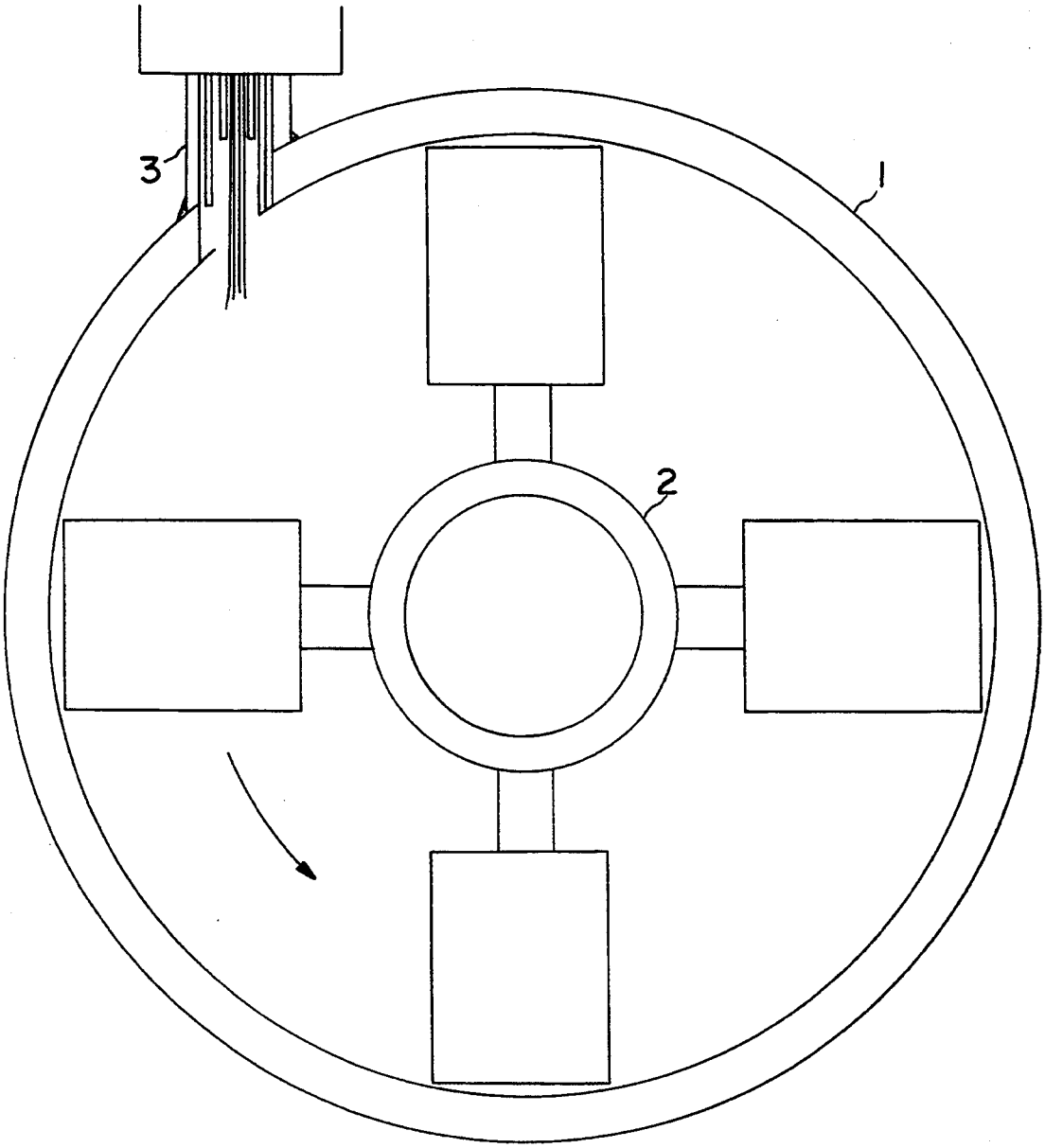
FIG. 1 is a transverse cross sectional view of a mixer according to the prior art.
Figure 2:
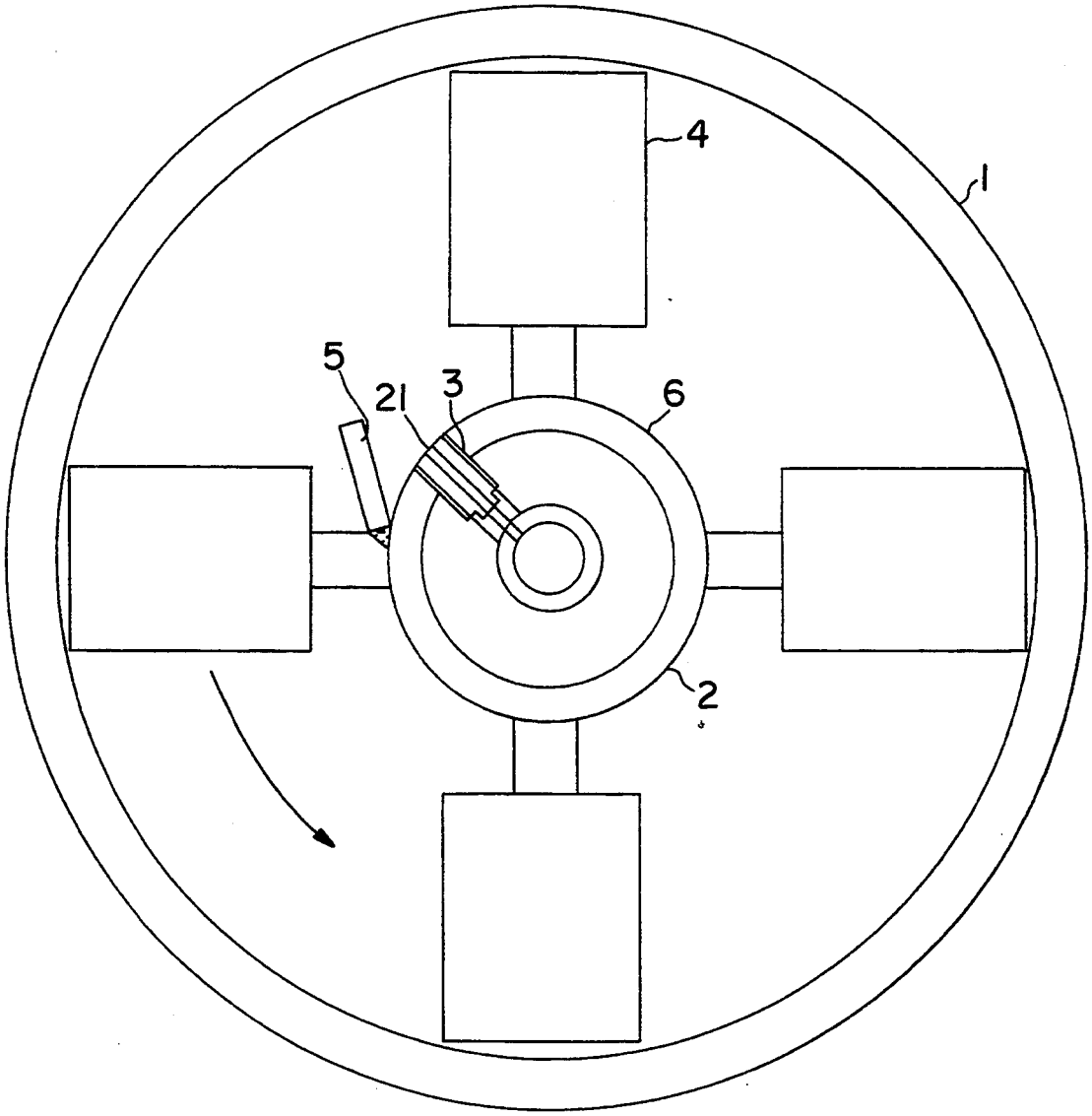
FIG. 2 is a transverse cross sectional view of a mixer according to the invention.

According to FIG. 2, the mixer according to the present invention is constituted by a trough 1 preferably of circular cross section, within which is mounted rotatably an axle 2 delimiting a space 10 and therefore called a screw. Thus, this axle can, in the particular embodiments of the invention, bear at one of its ends a helicoicial spiral and along the rest of the axle paddles 4 which are mounted fixedly on the axle. These paddles 4 facilitate, because of their shape, a mixture of constituents. It is therefore particularly important, in order to avoid any poor mixing, to have the paddles in perfect condition. However, the wear of these paddles increases with the speed of rotation of the axle of the screw. Therefore it will be seen to be useful, thanks to the mixer according to the invention, to be able to reduce the speed of rotation of the axle 2. However, this high speed of rotation of the axle is necessary to permit good diffusion of the constituents injected in the course of mixing. In the case of the mixer according to the invention, as at least one of the constituents is incorporated through the axle of the screw, even a low speed of rotation will subject the constituent to centrifugal force and thus project it toward the internal peripheral wall of the trough, forcing it to pass through the layer of principal constituent. As a result, the fact alone of changing from injection according to FIG. 1 to injection according to FIG. 2 offers as its first advantage being able to reduce the speed of rotation of the axle and hence the wear on the paddles.

Figure 3:
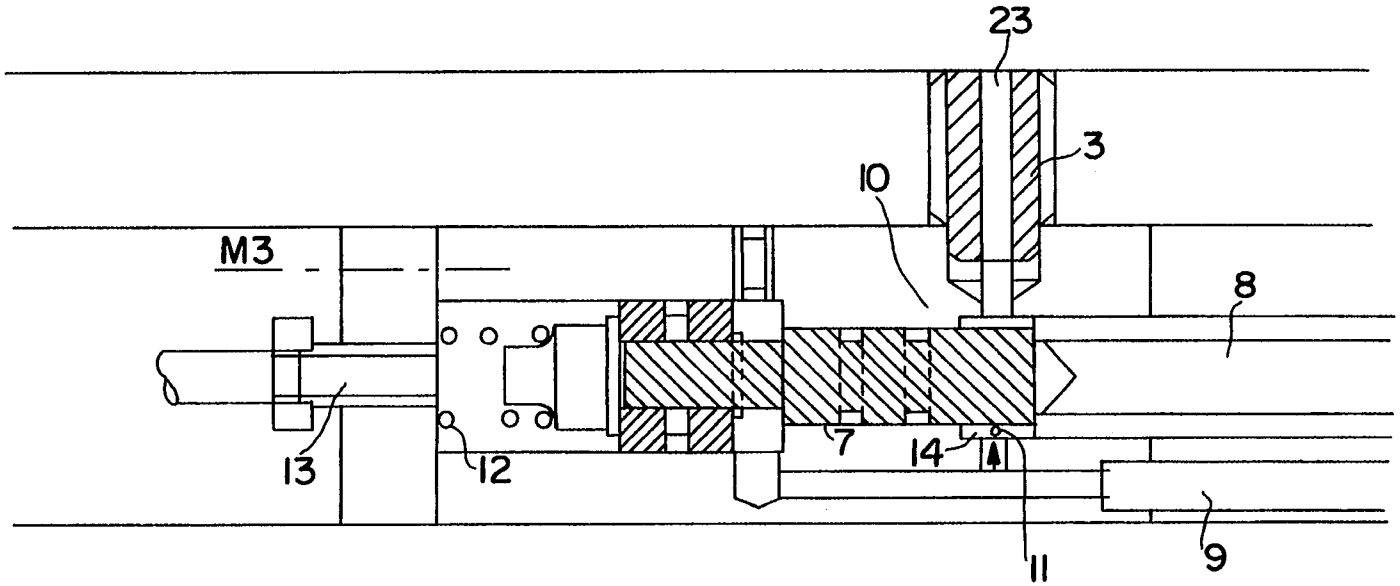
FIG. 3 is a side cross sectional view of a distributor disposed within the rotatable axle of the mixer.

The injection of one of the constituents of the mixture, which in general is a constituent of low viscosity, it therefore effected at the periphery of the rotating axle 2 of the mixture, in general through an injection nozzle 3 disposed in the peripheral envelope of the axle as shown in FIG. 3.

Figure 5:
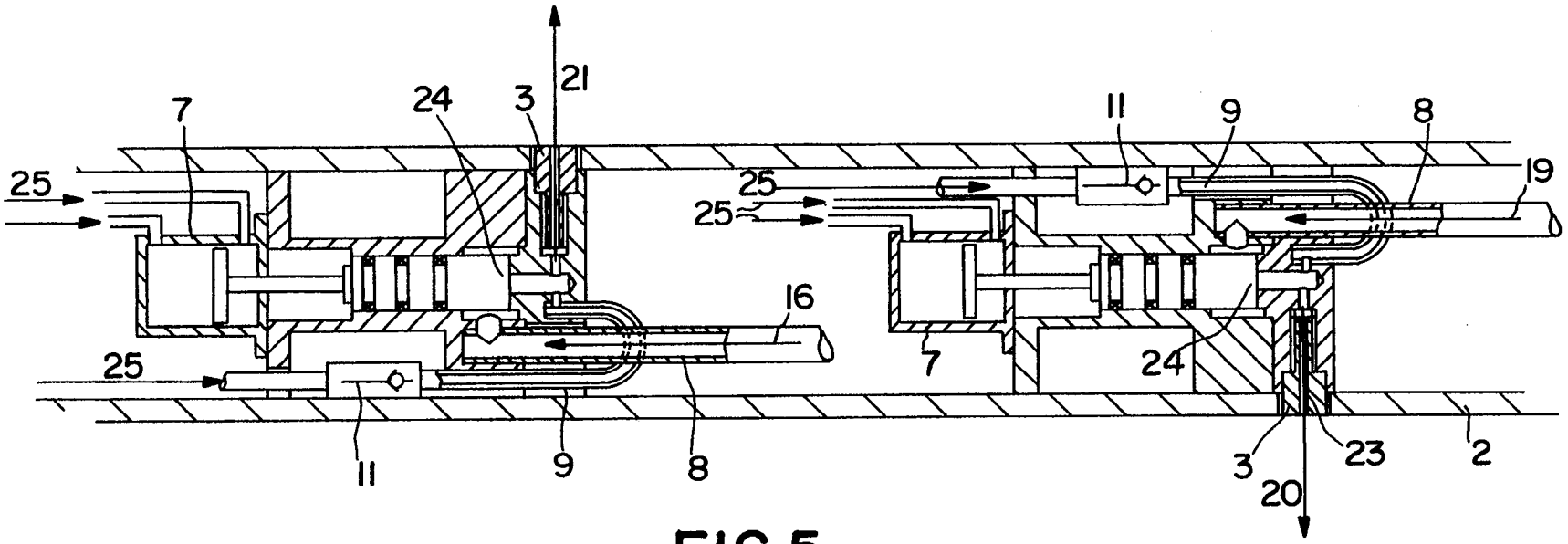
FIG. 5 is a side cross sectional view of two distributors disposed within the rotatable axle of the mixer.
Figure 6:
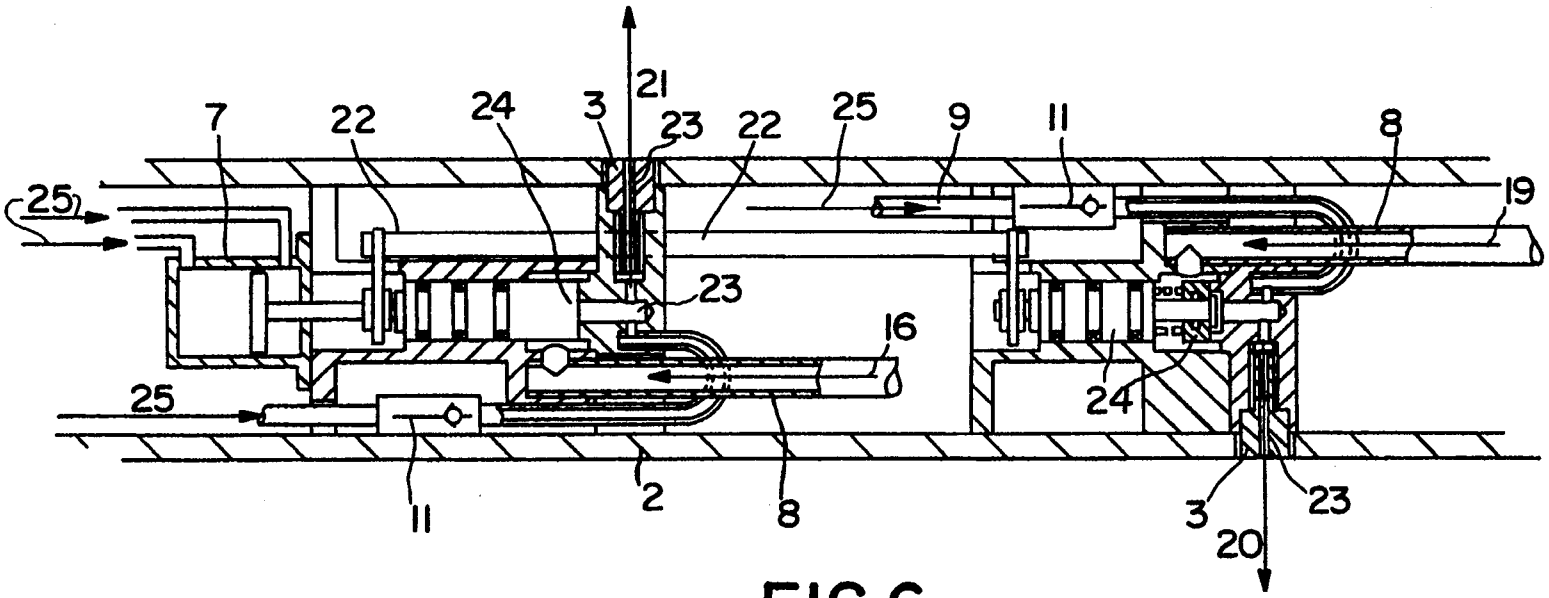
FIG. 6 is a side cross sectional view of two distributors with a single control jack for injection of the two constituents.

This injection nozzle constitutes one of the elements of the distributor 6 which can for example have a shape according to that of FIG. 3. This distributor 6 therefore comprises an injection nozzle 3 delimiting an injection channel 23. This injection channel 23 is directly connected to the constituent supply conduit 8 as shown in FIGS. 3, 5 and 6. Because of this, there is continuity between the two conduits 8 and 23, which provides the advantages of not dispersing the constituent before its exit from the axle 2 as is the case in all existing devices. Because of this, moreover, a precise dosage of the quantity of injected constituent can be effected. This distributor 6 of the constituents comprises moreover a jack 7 disposed adjacent the connection point of the pressurized supply conduit 8 of the constituent or constituents and the injection channel 23. The jack 7, driven in axial reciprocating movement within the rotatable axle 2, passes from an extended position in which it closes the pressurized supply conduit 8 of the constituent or constituents in the vicinity of its point of connection with the injection channel 23 preventing thereby any passage of the constituent from the supply conduit 8 toward the injection channel 23. On the contrary, in a retracted position, it exposes the inlet of the injection channel and permits communication of the supply conduit 8 with the injection channel 23 thereby permitting injection into the trough 1 of the constituent or constituents contained in the pressurized supply conduit 8. Generally, in the retracted position, the jack 7 enters already partially into the constituent supply conduit 8 or the injection conduit 23. This radial penetration of the jack 7 is such as to obstruct only partially one of the conduits so as to permit flow of the constituent and its exit from the injection channel. In extended position, on the other hand, the jack obstructs completely one of the conduits and prevents communication of its contents with the other conduit. Obviously, a large number of embodiments of the conduit 8 and the injection channel 23 are possible to obtain this result. FIG. 3, in which the jack is shown in extended position, which is to say closing the inlet of the supply conduit 8 of the constituents, constitutes an example of an embodiment of the invention. In this position, it will be noted that the end of the rod of the jack comes into sealed bearing on the bevels provided at the interior of the wall of the supply conduit 8 for the constituents. Thanks to these oblique surfaces, the constituent is segregated in its supply conduit 8. Because of this, one is certain of obtaining a precise and exact closage of the constituents to be injected. It will also be noted that the jack 7 is maintained in this extended position, which can be considered the rest position, by return means 12 such as a spring disposed behind the body of the jack 7. In conclusion, in this case, the jack is disposed coaxially of the supply conduit 8 for the constituent.

According to another embodiment of the invention as shown in FIGS. 5 and 6, the jack 7 can be disposed coaxially to at least one portion of the injection channel 23. In this case, the jack 7 penetrates transversely into the constituent supply conduit 8 and comes in its extended position to close the injection channel 23 at the point of connection between the injection channel and the supply conduit.

It is also preferable to provide cleaning means of the injection channel such that between each constituent injection, and even during a constituent injection, it will be possible to evacuate from the assembly waste that can remain in the injection channel 23 or can penetrate the same. This penetration is frequent when mixing material such as sand. These cleaning means are constituted by a supply conduit for cleaning fluid 9 disposed within the axle 2 and which opens downstream of the inlet point of the constituent supply conduit 8 closed by means of the jack 7. Thus, in the case of FIG. 3, during extension of the jack 7, the rod of said jack closes the constituent supply conduit 8 and delimits an annular space 14 into which empties the supply conduit 9 for the cleaning fluid. This annular space 14 places in communication the supply conduit 9 for the cleaning fluid with the channel 23 of the injection nozzle 3 so that the cleaning fluid flows from the conduit 9 and cleans the channel and the injection nozzle 3 to avoid any backup or blocking. This cleaning fluid is preferably a gaseous fluid 25 for example compressed air. In the case of FIGS. 5 and 6, the supply conduit 9 is also disposed downstream of the closure point of the conduit 8 for feeding constituents. This air supply conduit 9 can moreover serve also for the displacement of the jack by supplying this air 25 to the rod side 13 of the jack in the case in which of course the jack 7 is pneumatically actuated. Finally, the communication opening between the air supply conduit 9 and the constituent supply conduit 8 is closed by a one-way valve 11 so as to ensure a seal between the two constituents when the jack 7 is in retracted position. It will be noted that in FIGS. 5 and 6, this one-way valve is not disposed exactly at the cleaning fluid outlet, for simplification of production, but this arrangement is less preferable.

Moreover, it is possible to incorporate several constituents in the mixture by several distributors. In this case, the jacks can be mounted in series or in parallel as shown in FIGS. 5 and 6. Thus, in the case of FIG. 5, there is disposed within the axle 2 of the mixer two distributors 6 independently mounted and parallel, each comprising its own air supply 25 and constituent supply. Such a distributor permits incorporating two different constituents into the mixture. On the contrary, in the case of FIG. 6, the control jack 7 controls the displacement of two pistons 24 forming a valve thanks to a connector rod 22 which connects two pistons. In this case, the distributors are mounted in series. Such a mounting permits injection of two different constituents simultaneously.

Figure 7:
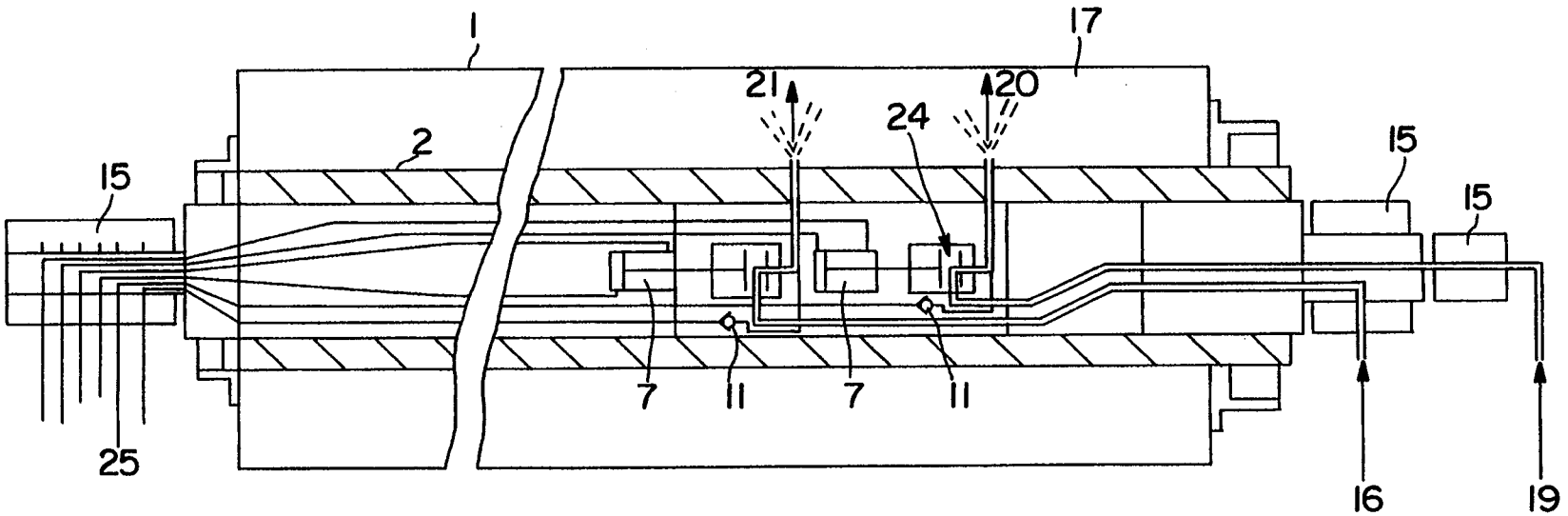
FIG. 7 is a simplified schematic view of the assembly of the mixer shown in FIG. 5 with the different points of injection of the constituents.

Finally, to improve the assembly, there can be provided at the outlet of the channel of the injection nozzle 3, at the point of injection 20 or 21 a deflector 5, according to FIG. 2, which prevents the constituents from becoming lodged at this location. Finally, to ensure air supply and constituent supply in the rotatable axle 2, it is provided that the reservoirs for air and for constituents will be connected to the supply conduits of the distributor by at least one rotatable coupling 15 mounted at at least one of the ends of the rotatable axle. In the case of the mixer of FIG. 7, there are provided two rotatable couplings 15, disposed at each of the ends of the axle 2, one connecting the conduits to the air reservoirs 25, the other to the product reservoirs.

Thanks to the configuration of this distributor which, thanks to its continuous distribution device of the constituents, includes an intermittently operating cleaning device, there are eliminated all problems of backing up, plugging, etc. encountered until now.

Figure 4:
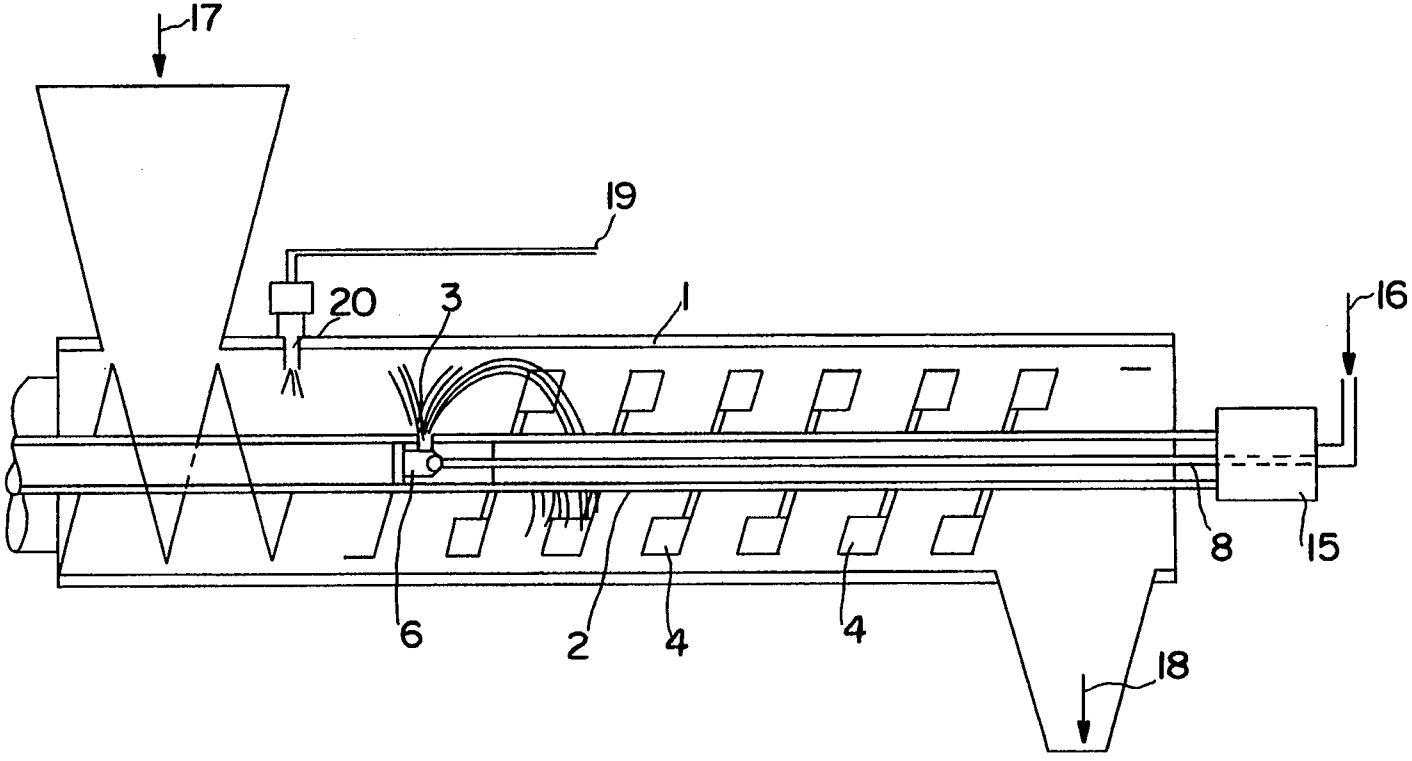
FIG. 4 is a side cross sectional view of the assembly of the mixer with the different points for an introduction of the constituents.

It is to be noted that, thanks to the particular arrangement of this cleaning device, it is possible to inject air 25, including at the injection position of the constituents in the case in which there is superatmospheric pressure at a time T. Moreover, the passage from cleaning to injection and the reverse is immediate and does not require additional members on this device. Thanks to this mixer permitting particular incorporation of the constituents, there are obtained important advantages in the finished products. Thus, in such a mixture, there is preferably introduced continuously at one end of the mixer the principal element of the mixture, in this case for example sand 17. It is to be noted that the supply inlet of this constituent 17 is located adjacent one of the ends of the mixer screw in the peripheral wall of the trough 1. The mixer is in this case a mixer with a horizontal axle and the supply of the principal constituent is from above. This mixer could be in the same way a vertical mixer. There would then be injected through the axle 2 of the screw at at least one point along the axle a second constituent 16 of the mixture. This second constituent, generally resin, is injected into the mixture by an injection nozzle 3 at 21 thanks to the resin distributor 6. The resin supply 16 is effected by the supply conduit 8 itself connected to a resin reservoir (not shown) by a rotatable coupling 15. The second constituent 16 diffuses under the action of centrifugal force due to the rotation of the screw, through the mixture, and the homogeneous mixture is recovered at the other end of the mixer, again at the peripheral wall of the trough designated 18 in FIG. 4. Thus, thanks to the diffusion of the second constituent within the principal constituent, there is obtained a much more homogeneous mixture than with a mixer according to the prior art. Because of this, the quality of the final products is influenced. Thus, if this second constituent had for its purpose to improve the mechanical properties of the mixture, there would be seen a large increase of the resistance to bending of the principal product. Because of this, there can accordingly be decreased the quantity of the second constituent used, while preserving the same mechanical properties.

It is also possible to inject into the mixture a third constituent 19, for example a catalyst. The point of injection of this catalyst could be disposed either at 20 on the peripheral wall of the trough (FIG. 4), or on the axle 2 at a peripheral point also designated 20 in FIG. 7 of the axle 2. It is in this second case that the mixers according to FIGS. 5 and 6 are particularly interesting.

The configuration of such a mixer is particularly interesting in the case of production of foundry molds or cores. In this case, there is first injected the sand which arrives continuously through one end of the mixer, then the catalyst, then the resin. This is why the point of injection of the catalyst should be disposed upstream of that of the resin. Thanks to this arrangement of the injection points of the resin and the catalyst, there is eliminated any risk of exothermic reaction. Moreover, as the quantity of resin used can be decreased, it becomes much more easy and quick to regenerate the sand, thereby to save time and money. In conclusion, this process of incorporation of the constituents has a large number of advantages relative to that of the prior art.

Of course, the order of injection of the constituents, the number of points of injection and the placement of these injection points could be modified and adapted as a function of the proposed use. Similarly, the constituents of the mixture can vary as to number and quality as desired, without departing from the scope of the invention.

I claim:

1. Mixer comprising an axle (2) mounted rotatably within a trough (1) and said axle having at a periphery at least one opening constituting an injection point (21) of at least one of several constituents of a mixture, said at least one constituent being supplied to said injection point (21) by means of a distributor (6) disposed within the axle (2), said distributor (6) comprising at least one injection nozzle (3) disposed at the injection point (21) in a wall of the axle (2) delimiting an injection channel (23) directly connected to a pressurized supply conduit (8) having an inlet for supplying said at least one constituent, and at least one jack (7) driven in axial reciprocatory movement within said axle to pass from an extended position in which said jack closes the inlet of the constituent supply conduit (8) opening into the injection channel (23) and a retracted position in which said jack exposes the inlet of said constituent supply conduit thereby permitting communication of the constituent supply conduit with the injection channel of the injection nozzle (3) and thus the injection into the trough (1) of said at least one constituent contained in the constituent supply conduit (8).

2. Mixer according to claim 1, wherein the jack (7) is maintained in extended position by return means (12).

3. Mixer according to claim 1, wherein the distributor (6) comprises a single control jack (7) provided with at least two jack heads (24) interconnected by a connecting rod (22).

4. Mixer according to claim 1, wherein the distributor further includes a supply conduit (9) for supplying cleaning fluid to the injection channel, said cleaning fluid supply conduit opening downstream of the injection point of the constituent supply conduit (8) closed by means of the jack (7).

5. Mixer according to claim 4, wherein the cleaning fluid supply conduit communicates via a communication opening with the injection channel, said communication opening being closed by a one-way valve (11).

6. Mixer according to claim 4, wherein the cleaning fluid is a gas under pressure.

7. Mixer according to claim 4, further including separate reservoirs for storing cleaning fluid and constituents, said reservoirs being fluidly connected to the supply conduits of the distributor by at least one rotatable coupling (15) mounted at at least one of the ends of the rotatable axle (2).

* * * * *